United States Patent [19]

Hansen

[11] Patent Number: 5,009,309

[45] Date of Patent: Apr. 23, 1991

[54] DOUBLE CHAMBER RECEPTACLE

[76] Inventor: Bernd Hansen, Heerstrasse 16, 7166 Sulbach-Laufen 2, Fed. Rep. of Germany

[21] Appl. No.: 396,929

[22] Filed: Aug. 22, 1989

[30] Foreign Application Priority Data

Sep. 29, 1988 [DE] Fed. Rep. of Germany ..... 3833036

[51] Int. Cl.[5] ..... B65D 3/04

[52] U.S. Cl. ..... 206/219; 206/820; 206/568

[58] Field of Search ..... 206/219, 820, 221, 223, 206/168

[56] References Cited

U.S. PATENT DOCUMENTS 2,798,488 7/1957 Hall ..... 128/232
3,610,297 10/1971 Raaf ..... 141/27
4,550,825 11/1985 Sutryn et al. ..... 206/219
4,573,506 3/1986 Paoletti ..... 141/98
4,779,991 10/1988 Kitamura et al. ..... 206/219

FOREIGN PATENT DOCUMENTS 0238878 9/1987 European Pat. Off. .

*Primary Examiner*—Joseph Man-Fu Moy

[57] ABSTRACT

The two chambers of a double chamber receptacle, especially a double chamber ampoule, are formed by two containers. The containers are arranged adjacent to one another, connected detachably and are closed by removable stoppers. One container has a neck forming the filling and/or drawing out opening with an outer conical member tapering toward the open end of the neck. The other container has a neck forming the filling and/or drawing out opening with an inner conical member configured correspondingly to the outer conical member of the one container and tapering toward the inside of its container.

12 Claims, 1 Drawing Sheet

DOUBLE CHAMBER RECEPTACLE

FIELD OF THE INVENTION

The present invention relates to a double chamber receptacle, especially to a double chamber ampoule, in which two different substances can be stored separately and then mixed and used.

BACKGROUND OF THE INVENTION

Conventional double chamber receptacles are intended to hold two different materials, which materials may not come into contact with one another until use. The receptacles are configured such that the two materials must be extracted from the receptacles prior to mixing and in order to be able to bring the materials together in a separate vessel.

SUMMARY OF THE INVENTION

An object of the present invention is to provide a double chamber receptacle having an improved and expanded range of possible uses.

This object is provided by a double chamber receptacle, particularly a double chamber ampoule, comprising first and second containers arranged adjacent one another and detachably coupled together. The first and second containers have first and second chambers, respectively, and first and second stoppers closing the first and second containers, respectively. A first neck on the first container has a filling-removing opening and a conical outer surface tapering toward an open end of the first neck. A second neck on the second container has a filling-removing opening and has a conical inner surface configured to mate with the conical outer surface and tapering toward an inside of the second container.

The chambers of the two containers of the receptacle are separate from one another and the containers can be separated manually. Since the conical members correspond and fit or mate with each other, a tight plug connection can be produced permitting the contents of the two containers to be combined and mixed thoroughly together. This mixing and combining can be accomplished without requiring an additional container solely for this purpose. The tight plug connection also allows the two containers to be shaken. If at least one of the two containers is deformable, the deformable container can be compressed slightly before the plug connection is produced, forming a slight vacuum pressure for sucking or drawing a liquid out of the other container.

Furthermore, it is advantageous that the neck of the one container form an inner conical member. This is preferable for ampoules constructed corresponding to standard dimensions used for medication-dispensing apparatus, so that the sleeve or conical fitting at the end of a syringe or the like can be introduced into it.

The double chamber receptacle according to the present invention permits filling one container only partially. When the two containers are plugged together, a relatively large space is available. This is advantageous, for instance, when the contents of the filled container must be moved back and forth before use or must be thoroughly shaken.

In one preferred embodiment, the two stoppers are tip-stretched into their shape and are shaped on one and the same toggle member. With the aid of this toggle member, each one can then be removed practically simulataneously from the respective neck which is supporting it.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
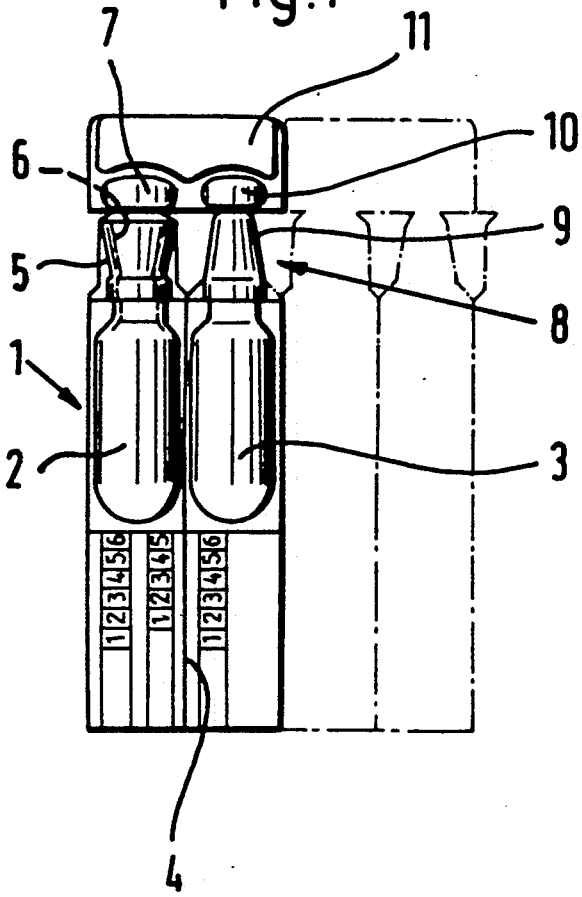
FIG. 1 is a front elevational view of a receptacle before use according to the present invention.
Figure 2:
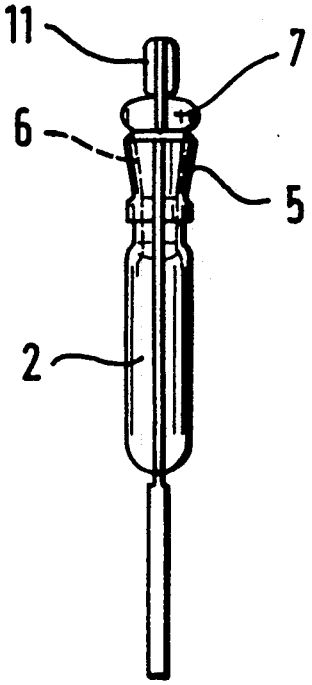
FIG. 2 is a side elevational view of the receptacle taken from a position at a 90° angle from FIG. 1.

A rudimentary representation of an ampoule unit 1 according to the present invention comprises several identically configured double chamber ampoules. The two chambers are arranged adjacent to one another, and are formed of plastic material by the blowing method or by use of a vacuum. During simultaneous formation of one ampoule 2 and the other ampoule 3, a partition zone 4 is produced between the bodies of the two ampoules. The partition zone holds these two bodies together. However, they can be separated when ampoule 2 is moved relative to the other ampoule 3 in the area of partition zone 4. The two ampoules 2 and 3 are filled with two different materials during their manufacture, and then are closed.

During the ampoule closing process, a neck 5 is shaped and tip-stretched on ampoule 2, forming an inside conical member or inner conical surface 6. Conical member 6 widens outwardly toward the open end of the neck. This inside conical member has the standard shape and size for medication-dispensing apparatus (see for example, DIN-standard 13 090, dated June 1974, the subject matter of which is hereby incorporated by reference) so that the sleeve or conical fitting at the end of a syringe or the like can be introduced into it to transmit the contents of the ampoule into the syringe or the like. A head or stopper 7, which occludes or closes conical member 6, is tip-stretched and shaped on neck 5, and is attached such that it can be separated from neck 5 without a cutting tool or the like.

The other ampoule 3, has the identical shape and size as ampoule 2, viewed from its neck down. It is likewise to be filled, if required before its neck 8 is formed, and is occluded like the other neck. Neck 8 forms an outside conical member or outer conical surface 9 configured correspondingly to inside conical member 6. A head or stopper 10 occludes neck 8. Head 10, in an identical manner to head 7, is tip-stretched and shaped on a toggle member 11. Heads 7 and 10 can be separated from their associated necks when toggle member 11 is bent to the side.

Figure 3:
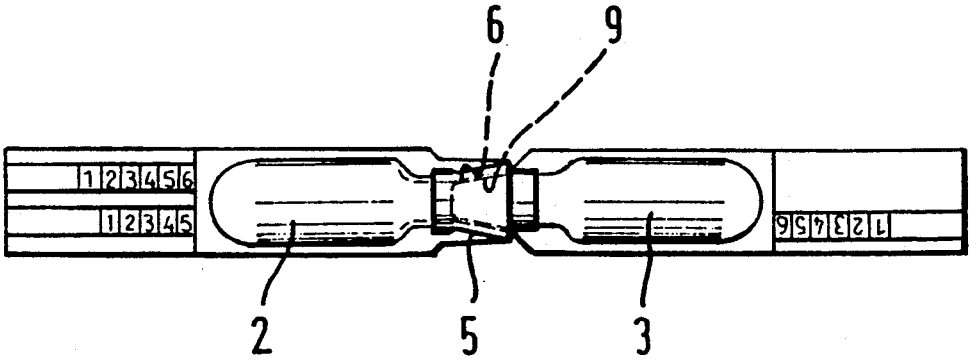
FIG. 3 is a front elevational view of the receptacle of FIG. 1 after the plug connection is formed.

After ampoules 3 and 4 have been opened, it is possible to separate them from one another along partition zone 4. After separation, the outside conical member 9 is inserted into inside conical member 6, as shown in FIG. 3, to be able to combine the contents of one ampoule with the contents of the other ampoule. Since at least one of the two ampoules is only partially filled, as is generally the case, sufficient space is present to attain a thorough mixing by shaking. This is still the case when one of the two ampoules is completely filled. Ampoules 2 and 3 are form-stable, but are deformable under pressure. Thus, it is also possible, insofar as at least one of the two ampoules is only partially filled, to press this partially filled ampoule between the fingers, and then to maintain the pressure when producing the plug connection. If this is done, it is possible in a simple manner to at least partially suck or draw the contents from the ampoule which has not been pressed together.

After the contents of the ampoules are prepared for application, the entire contents can be located in ampoule 2 through the inside conical member. Subsequently, the plug connection can be broken. The conical fitting at the end of a syringe or the like can then be introduced into inside conical member 6, to draw out the contents of ampoule 2 into the syringe or the like. This drawing out can also occur in the traditional manner with ampoule 2 in a position in which its neck 5 is turned downward.

All of the features described in the above description, as well as the features which only can be assumed from the drawings are further developments and component parts of the invention, even though not specifically raised and described in the specification and not especially recited in the claims.

While a particular embodiment has been chosen to illustrate the invention, it will be understood by those skilled in the art that various changes and modifications can be made therein without departing from the scope of the invention as defined in the appended claims.

What is claimed is:

1. A double chamber receptacle, particularly a double chamber ampoule, comprising:

first and second containers arranged side-by-side, adjacent to and generally parallel to each other and detachably coupled together by a frangible partition zone before opening and mixing contents thereof, said first and second containers having first and second chambers, respectively;

first and second stoppers closing said first and second containers, respectively;

a first neck on said first container having a filling-removing opening and a conical outer surface tapering toward an open end of said first neck; and a second neck on said second container having a filling-removing opening and having a conical inner surface configured to mate with said conical outer surface and tapering toward an inside of said second container;

whereby the contents can be mixed by detaching said containers, removing said stoppers and inserting said first neck into said second neck.

2. A double chamber receptacle according to claim 1 wherein said inner and outer conical surfaces have standard dimensions for tapered connections of medication dispensing apparatus.

3. A double chamber receptacle according to claim 2 wherein said stoppers are shaped on a single toggle member.

4. A double chamber receptacle according to claim 1 wherein said stoppers are shaped on a single toggle member.

5. A double chamber receptacle according to claim 4 wherein the receptacle is unitarily formed of plastic.

6. A double chamber receptacle according to claim 3 wherein the receptacle is unitarily formed of plastic.

7. A double chamber receptacle according to claim 2 wherein the receptacle is unitarily formed of plastic.

8. A double chamber receptacle according to claim 1 wherein the receptacle is unitarily formed of plastic.

9. A double chamber receptacle according to claim 8 wherein said necks are unitarily formed on the respective containers and are elastically deformable.

10. A double chamber receptacle according to claim 6 wherein said necks are unitarily formed on the respective containers and are elastically deformable.

11. A double chamber receptacle according to claim 4 wherein said necks are unitarily formed on the respective containers and elastically deformable.

12. A double chamber receptacle according to claim 1 wherein said necks are tip stretched onto the respective containers and are elastically deformable.

* * * * *